US006007352A

United States Patent [19]

Azuma et al.

[11] Patent Number: 6,007,352

[45] Date of Patent: Dec. 28, 1999

[54] ELECTRICAL CONNECTOR WITH SHIELDED POWER CONTACTS

[75] Inventors: Yoichiro Azuma, Tokyo; Yasuhiro Ono, Kanagawa; Shigenori Koike, Tokyo, all of Japan

[73] Assignee: Kez Corporation, Tokyo, Japan

[21] Appl. No.: 08/862,512

[22] Filed: May 23, 1997

[30] Foreign Application Priority Data

May 29, 1996 [JP] Japan ..... 8-134578
Feb. 6, 1997 [JP] Japan ..... 9-023428

[51] Int. Cl.[6] ..... H01R 4/66

[52] U.S. Cl. ..... 439/108; 439/570

[58] Field of Search ..... 439/101, 108, 439/570, 924.1

[56] References Cited

U.S. PATENT DOCUMENTS 4,582,386 4/1986 Martens ..... 439/101

5,356,300 10/1994 Costello ..... 439/101

*Primary Examiner*—Neil Abrams
*Assistant Examiner*—Javaid Nasri
*Attorney, Agent, or Firm*—Robert W. J. Usher

[57] ABSTRACT

A plug connector 1 and a receptacle connector 5 are provided with two poles of power plug contacts 30, 30 and power receptacle contacts 70, 70, respectively, at end portions of their housings 10 and 50 on the right and left sides of signal contacts 20, 60, and 60'. The right and left end portions of the housings 10 and 50 are provided with connector securing metal parts 40 and 80 made of a conductive material, which cover the power contacts 30 and 70, respectively, whereby the connectors can be attached to circuit boards. When both connectors 1 and 5 mate together, the connector securing metal parts 40 and 80, the power contacts 30 and 70, the contacts 60, 60', and 20 are successively connected to each other.

4 Claims, 7 Drawing Sheets

ELECTRICAL CONNECTOR WITH SHIELDED POWER CONTACTS

FIELD OF THE INVENTION

The present invention relates to a connector constituted by a plug connector and a receptacle connector which are adapted to mate with each other and, more specifically, a connector provided with contacts for power supply and metal parts for securing the connector in addition to contacts for signals.

BACKGROUND OF THE INVENTION

So-called notebook personal computers and the like are configured such that, in order to reduce the size of their main body, external storage devices such as FD and CD-ROM drives can be connected thereto by means of connectors. Also, such a notebook personal computer is typically constructed so as to use a rechargeable battery (so-called battery pack) as its power supply.

In order to connect with an external storage device, a signal connector having about 80 pins of signal contacts is necessary, while a power connector having a power contact with a capacity larger than that of the signal contacts is required for connecting with a battery pack. When both the signal connector for connecting with the external storage device and the power connector for connecting with the battery pack are provided, the notebook computer, which has a limited space for utilizing connectors, is likely to increase in size.

Accordingly, the connector utilized in the personal computer may be configured so as to be used as both signal connector and power connector, such that the external storage device and the battery pack can selectively be connected thereto when necessary. A conventional commonly usable connector is one in which two poles of power contacts are respectively disposed at right and left end portions of a plurality of signal contacts aligned in the right-to-left direction.

In the thus configured personal computer, each connector is attached thereto by means of a securing metal part disposed at the housing of the connector. While each connector is constituted by a plug connector and a receptacle connector as mentioned above, a case or circuit board to which the plug connector or receptacle connector is to be attached individually has a ground, and each securing metal part is connected to this ground.

Since the case and circuit board having respective connectors attached thereto may have different potentials, however, a potential difference may be generated between the case and circuit board when the connectors are mated together, thereby causing a noise to occur.

Also, in the connector configured as mentioned above, there are cases of so-called hot-plugging, in which the connectors are mated together or detached from each other while electric power is supplied to the power contacts. When the connectors are mated together while electric power is supplied to the power contacts, however, a voltage or current higher than the rated level may flow (generating a so-called "peak") at the time when the contacts are connected to each other, thereby generating a noise, which may be mistaken as other signals. Thus, hot-plugging may cause undesirable affects.

SUMMARY OF THE INVENTION

In view of the aforementioned objective, it is an objective of the present invention to provide a connector which can connect with a signal and a power supply, can reduce the noise generation at the time of connection, as well as be hot-pluggable.

In order to attain such an objective, the connector in accordance with the present invention comprises a plug connector holding a plurality of signal plug contacts, each extending in the vertical direction, aligned in the right-to-left direction within a plug housing; and a receptacle connector holding a plurality of signal receptacle contacts, each extending in the vertical direction, aligned in the right-to-left direction within the receptacle housing; whereas both signal contacts are connected together as the plug connector is received in and mated with the receptacle connector.

Also, the plug connector is provided with two poles of power plug contacts disposed so as to align with the signal plug contacts in the right-to-left direction, whereas the receptacle connector is provided with two poles of power receptacle contacts, which are connected to the power plug contacts in a state where the plug connector is received therein and mated therewith, disposed so as to align with the signal receptacle contacts in the right-to-left direction. Further, a plug-connector securing metal part made of a conductive material is disposed at each of right and left ends of the plug housing so as to allow the plug connector to be attached to a desired position.

On the other hand, a receptacle-connector securing metal part similarly made of a conductive material are disposed at both right and left ends of the receptacle housing so as to allow the receptacle connector to be attached to a desired position, while being adapted to connect with the plug-connector securing metal part when the plug connector and the receptacle connector mate together.

Since the signal contacts and power contacts are arranged in a single row in the right-to-left direction, thus configured connector can reduce its size. Also, in the state where both connectors mate together, the connector securing metal parts are connected together. Accordingly, when the connector securing metal parts are disposed so as abut to grounds of their corresponding circuit boards, the grounds of their circuit boards can be connected together. Consequently, the potential difference between the circuit boards can be minimized.

Preferably, the plug-connector securing metal part and the receptacle-connector securing metal part are disposed so as to respectively cover at least part of the outer peripheries of the power plug contacts and power receptacle contacts. In this configuration, a part of the outer periphery of the power contacts can be shielded by the securing metal parts, thereby reducing the noise generated by the connector at the time when electric power is supplied to the power contacts.

Also, the power plug contacts and power receptacle contacts may be disposed at positions asymmetrical to each other in the right-to-left direction with respect to the signal plug contacts and signal receptacle contacts, respectively. In this configuration, connectors with the wrong power contact polarity can securely be prevented from mating together.

Preferably, the above-mentioned connector is configured such that, when the plug connector is received in and mated with the receptacle connector, the plug-connector securing metal part and the receptacle-connector securing metal part are initially connected together, then the power plug contacts and power receptacle contacts are connected together, and thereafter the signal plug contacts and signal receptacle contacts are connected together. In this configuration, the power contacts are connected together after each connector is connected to the ground, and the signal contacts are connected together after the power flowing through the power contacts is stabilized.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art.

BRIEF DESCRIPTION OF THE DRAWINGS

The present invention will become more fully understood from the detailed description given herein below and the accompanying drawings which are given by way of illustration only, and thus are not limitative of the present invention wherein.

DESCRIPTION OF THE PREFERRED EMBODIMENTS

Figure 1:
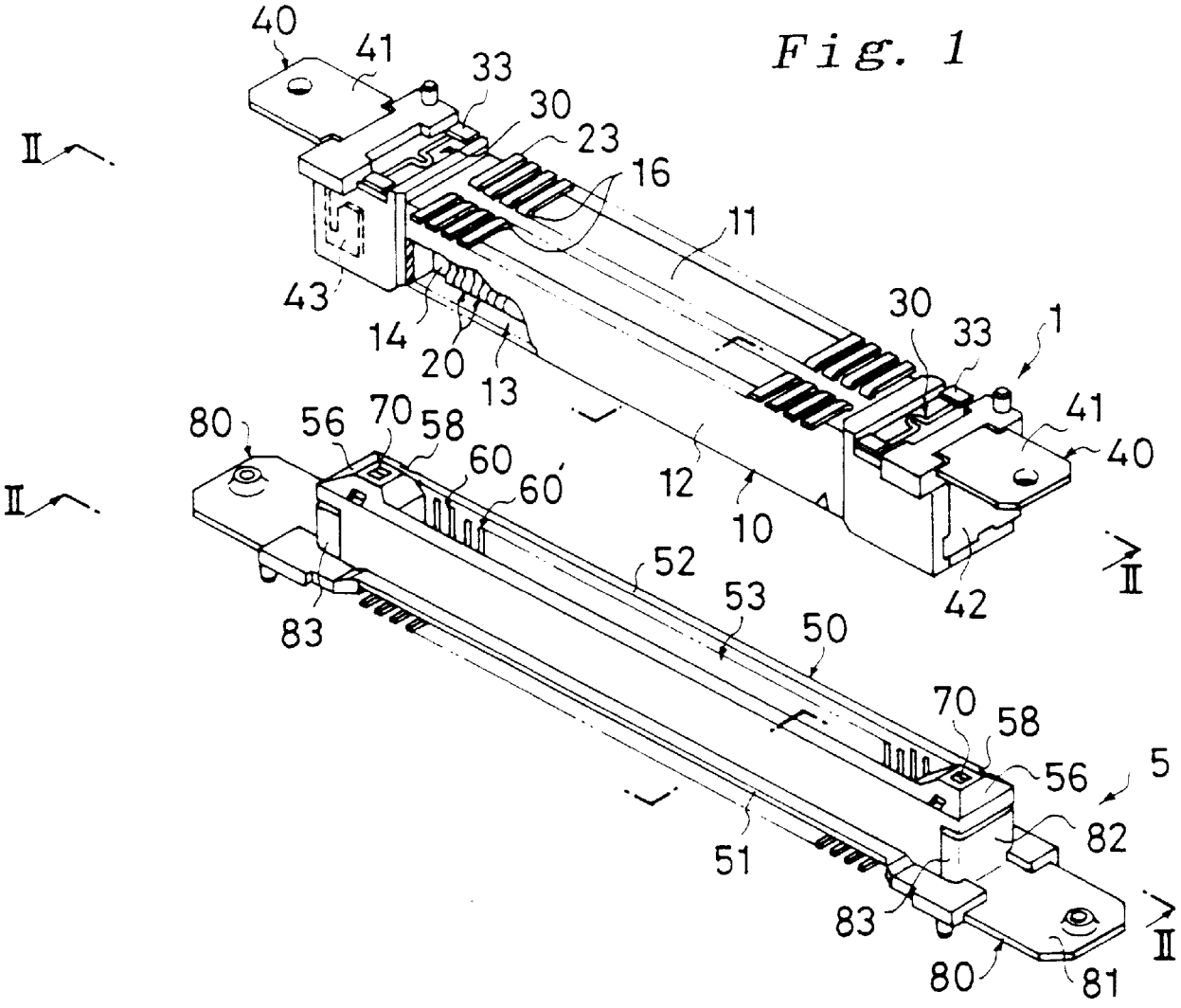
FIG. 1 is a perspective view showing a set of receptacle connectors and plug connectors serving as an example of the connector in accordance with the present invention.
Figure 2:
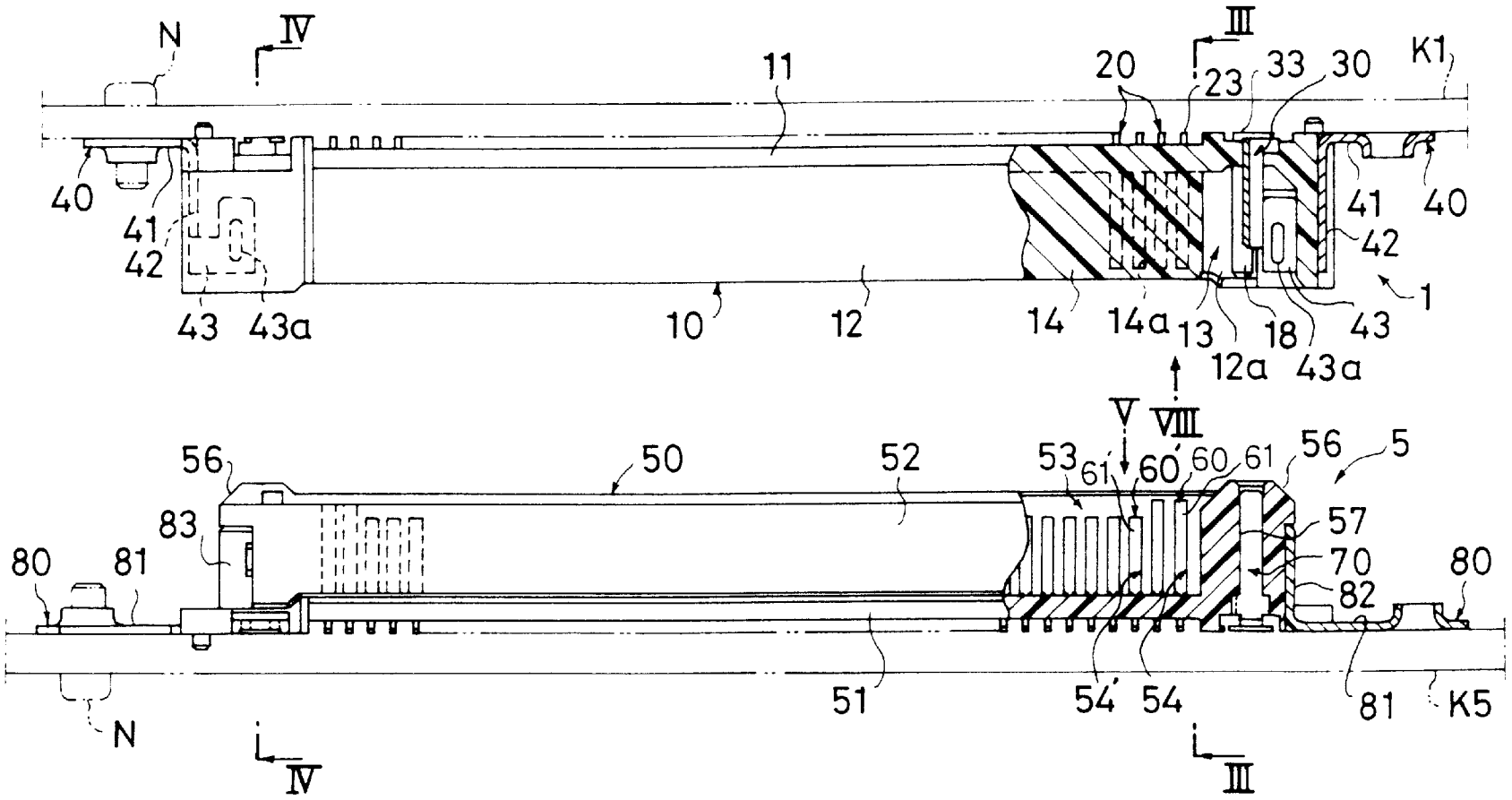
FIG. 2 is a cross-sectional view of the above-mentioned connector taken along line II—II in FIG. 1.
Figure 3:
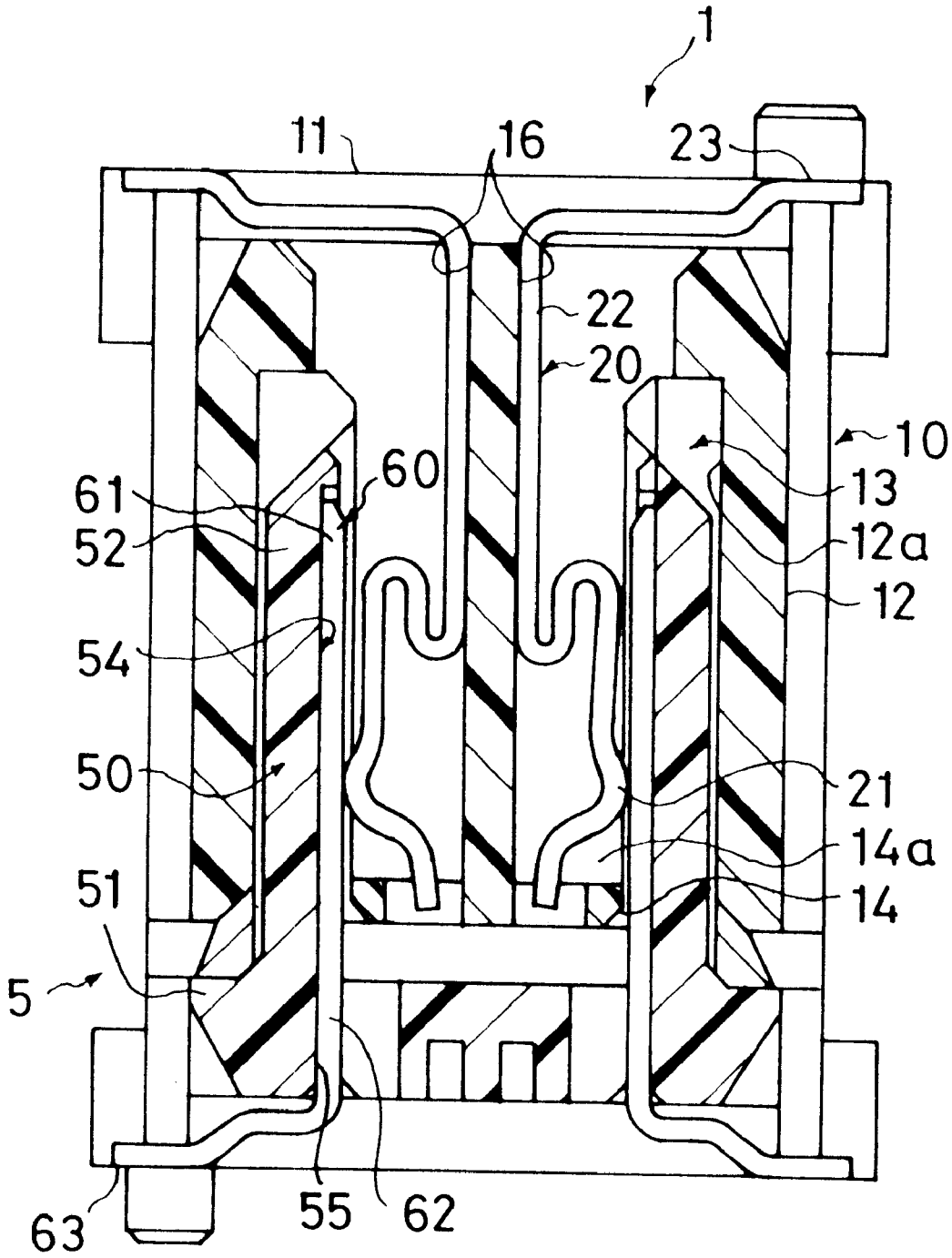
FIG. 3 is a cross-sectional view taken along line III—III in FIG. 2 showing the mating state of the above-mentioned connector.
Figure 4:
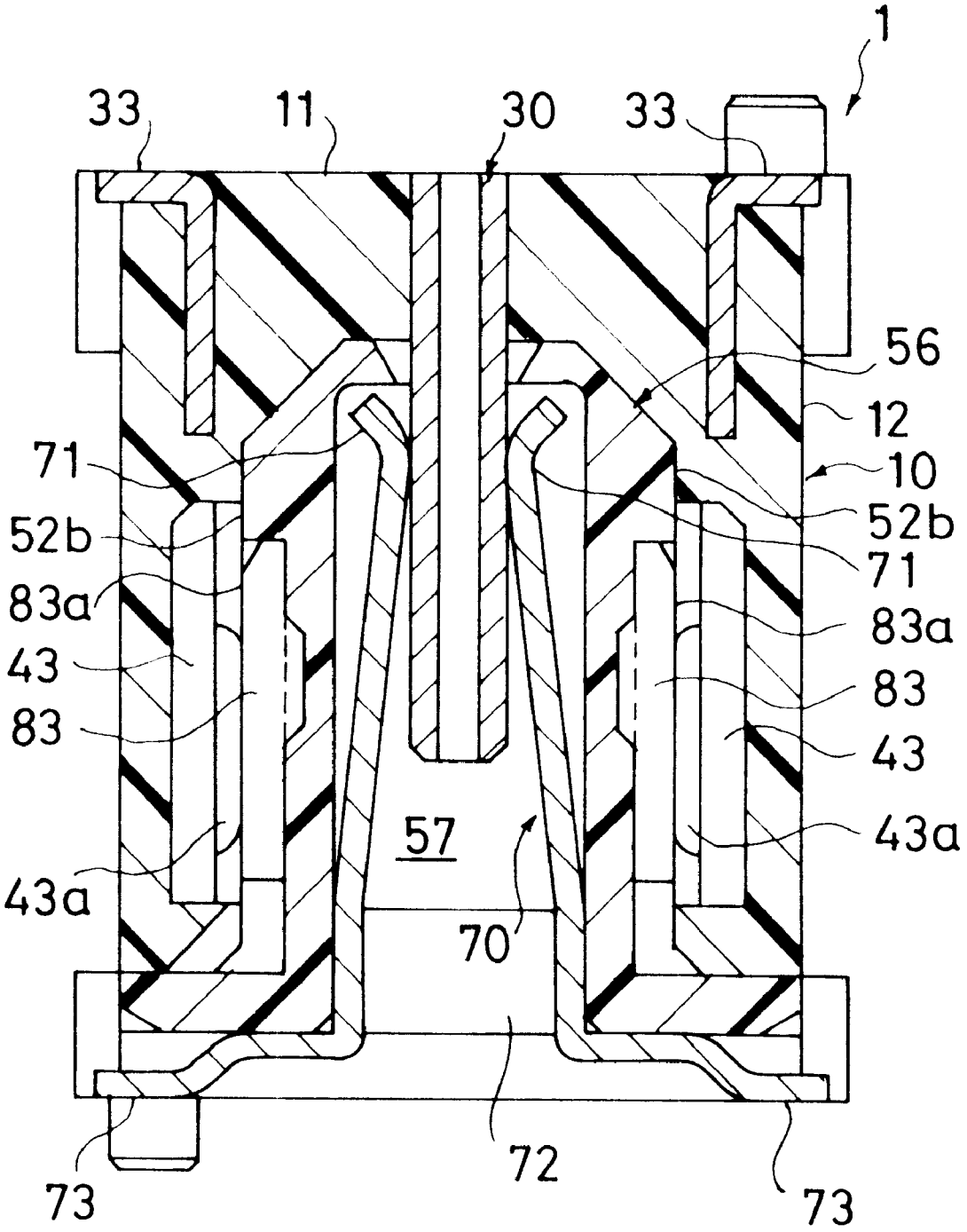
FIG. 4 is a cross-sectional view taken along line IV—IV in FIG. 2 showing the mating state of the above-mentioned connector.
Figure 5:
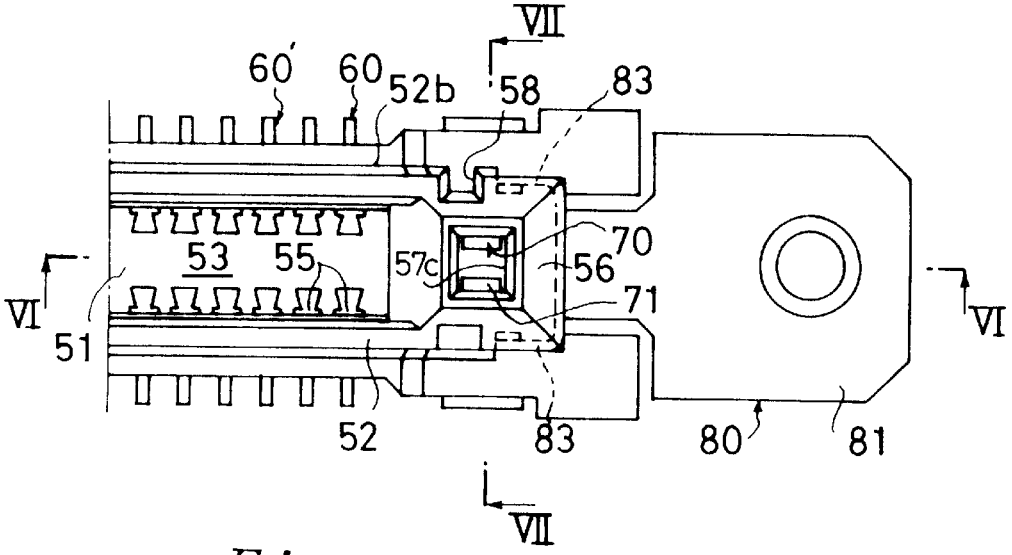
FIG. 5 is a partial enlarged view observed from arrow V in FIG. 2.
Figure 6:
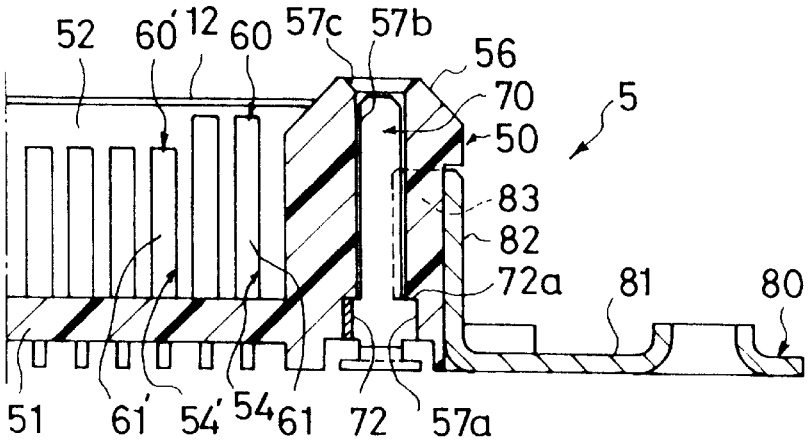
FIG. 6 is a cross-sectional view taken along line VI—VI in FIG. 5.
Figure 7:
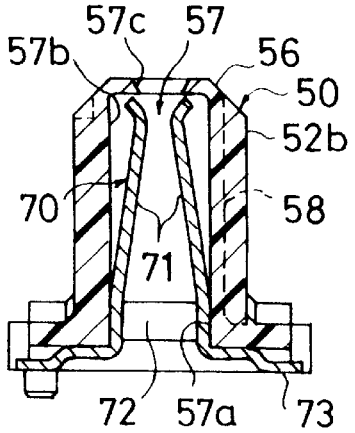
FIG. 7 is a cross-sectional view taken along line VII—VII in FIG. 5.
Figure 8:
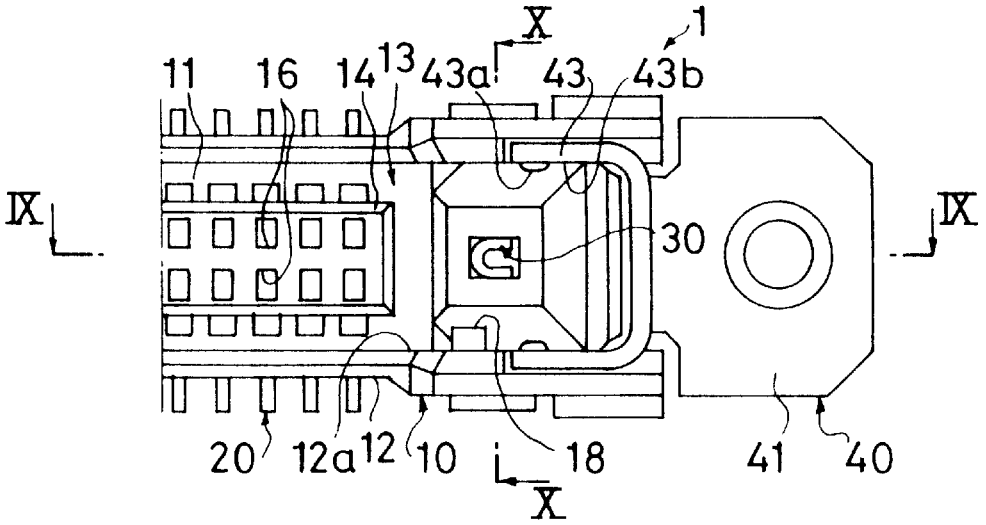
FIG. 8 is a view observed from arrow VIII in FIG. 2.
Figure 9:
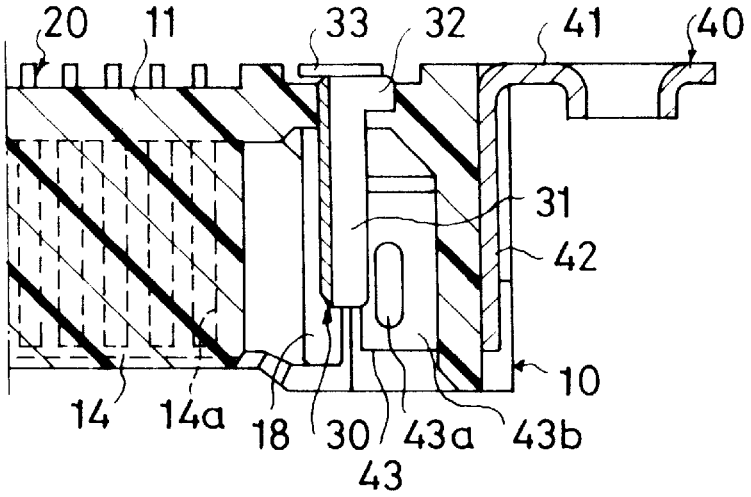
FIG. 9 is a cross-sectional view taken along line IX—IX in FIG. 8.
Figure 10:
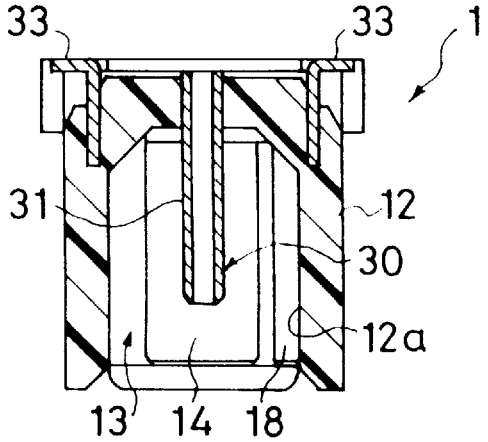
FIG. 10 is a cross-sectional view taken along line X—X in FIG. 8.

In the following, a connector in accordance with a preferred embodiment of the present invention will be explained with reference to accompanying drawings. As shown in FIGS. 1 to 10, this connector is constituted by a plug connector 1 and a receptacle connector 5. When they mate with each other, the contacts respectively disposed in both connectors connect with each other. While FIGS. 3 and 4 show both connectors in a mated state, the other drawings show a state where the connectors 1 and 5 are separated from each other.

First, the plug connector 1 will be explained. The plug connector 1 is configured such that a housing 10 made of an insulating material holds a plurality of plug contacts 20 as depicted. The plug housing 10, which comprises a rectangular sheet-like base section 11, an outer wall section 12 extending downward from under the base section 11 like a rectangular box, and a plug-contact holding section 14 extending downward from under the base section 11 inside of the outer wall section 12, is integrally formed. Consequently, an exterior plug space 13, which opens downward and is surrounded by the outer wall section 12 and the plug-contact holding section 14, is formed on the lower face side of the base section 11.

Bored in the base section 11 in two rows are through-holes 16, each vertically penetrating through the base section 11. The plug contacts 20 are pressed into and attached to the respective through-holes 16 from the upper face side. A plurality of guide grooves 14*a* are formed in the right and left outer side faces of the plug-contact holding section 14, whereby the upper portions of the plug contacts 20 pressed into the respective through-holes 16 enter into their corresponding guide grooves 14*a* so as to be guided thereby.

The exterior plug space 13 is provided with a positioning protrusion 18 projecting from an inner peripheral face 12*a* of the outer wall section 12. Though only one positioning protrusion 18 formed near the right end portion is shown in the drawings, vertically extending (two) positioning protrusions 18 are respectively formed near the right and left end portions only in the inner peripheral face 12*a* on the rear side.

Each plug contact 20 is made of a conductive material and comprises a contact section 21 which faces the exterior plug space 13 and is guided by the guide groove 14*a*, a press-fitting section 22 pressed into the through-hole 16, and a lead section 23 which horizontally extends from the press-fitting section 22 before being bent like a crank. The contact section 21 is formed to have a spring characteristic so as to expand outward, while having a lower portion curved inward so that the receptacle connector 5, which will be explained later, can easily mate therewith, i.e., attain so-called easy access.

Further, power plug contacts 30 are disposed at the left and right sides of the plug-contact holding section 14 in the exterior plug space 13. Each power plug contact 30 has a contact section 31 with a U-shaped cross section, which extends downward toward the opening of the plug housing 10. Formed above the contact section 31 is a press-fitting section 32 having a width in the right-to-left direction larger than that of the contact section 31. From the press-fitting section 32, a lead section 33 extends horizontally.

Further, attached to the right and left end portions of the plug housing 10 so as to extend outward are plug-connector securing metal parts 40, 40 which also serve as metal parts for grounding a printed circuit board K1. As will be explained later, in the state where the plug connector 1 and the receptacle connector 5 mate together, the plug-connector securing metal parts 40, 40 abut to receptacle-connector securing metal parts 80, 80 attached to a receptacle housing 50.

Each plug-connector securing metal part 40 comprises a planar section 41, a descending section 42 extending vertically downward from the planar section 41, and a holding section 43 extending from the lower end portion of the descending section 42 in the right-to-left direction into a U-shaped form. A contact 43*a* is formed at each inner side face of the holding section 43 so as to project inward. Thus configured plug-connector securing metal parts 40 are held by the plug housing 10 such that the right and left end portions of the plug housing 10 are held by the holding sections 43.

The outer wall section 12 in the part where the inner face of the holding section 43 is positioned while being held by the plug housing 10 is cut out such that the contact 43*a* projects into the exterior plug space 13. The inner peripheral face 12*a* of the outer wall section 12 and the inner face 43*b* of the holding section 43 are positioned on the same plane while being held by the plug housing 10. Here, the planar section 41 is burring-processed and is provided with a tap so as to be easily attached to a circuit board or the like.

Thus configured plug connector 1 is attached to the printed circuit board K1 by means of the tap formed in the planar section 41 with a securing thread N in the state where the planar section 41 abuts to the grounding wiring pattern formed in the printed circuit board K1 or the case, while the upper end face of the lead section 23 of the contact 20 and the upper end face of the lead section 33 of the power plug contact 30 are mounted and soldered on signal and power wiring patterns formed in the printed circuit board K1, respectively.

In the following, the receptacle connector 5 will be explained. The receptacle connector 5 is configured such that the receptacle housing 50 made of an insulating material holds a plurality of receptacle contacts 60, 60' as depicted. The receptacle housing 50, which comprises a rectangular sheet-like base section 51 and a side wall section 52 extending upward from above the base section 51 like a rectangular box, is integrally formed and opens upward, while defining above the base section 51 a receptacle-side space 53 which is surrounded by the side wall section 52. The right and left end portions of the side wall section 52 are respectively provided with right and left guide protrusions 56, 56 each having a truncated quadrangular pyramid form with a planar upper end face.

The part of the base section 51 positioned within the receptacle-side space 53 is bored with two longitudinally aligned rows of through-holes 55 vertically penetrating therethrough. The receptacle contacts 60, 60' are respectively pressed into the through-holes 55 from the lower face side. As depicted, a plurality of guide grooves 54, 54' are formed in the right and left inner side faces of the side wall section 52 so as to correspond to the through-holes 55, such that the upper portions of the receptacle contacts 60, 60' pressed into the through-holes 55 respectively enter into the guide grooves 54, 54' and are guided thereby. Here, the guide grooves 54 and 54' have the same cross-sectional form in the direction perpendicular to the vertical direction or the like except that the guide groove 54' has an upper portion shorter than that of the guide groove 54 since a contact section 61', which will be explained later in detail, is inserted therein and held thereby.

Formed near the right and left end portions in a rear face 52*b* of the side wall section 52 at the positions of the positioning protrusions 18, 18 in the state where the receptacle connector 5 receives and mates with the plug connector 1 are vertically extending positioning grooves 58, 58 into which the positioning protrusions 18, 18 can be inserted.

Each receptacle contact 60 comprises a contact section 61 which faces to the inside of the receptacle-side space 53 and is guided by the guide groove 54, a press-fitting section 62 pressed into the through hole 16, and a lead section 63 which extends horizontally from the press-fitting section 62 before being bent like a crank. In the receptacle contact 60', though the press-fitting section 62 and the lead section 63 have the forms identical to those in the receptacle contact 60, the contact section 61' is formed shorter than the contact section 61. Here, both contacts 60, 60' are made of a conductive material.

The guide protrusion 56 is bored with a power-contact holding hole 57 penetrating through the upper end face and base section 51. The power-contact holding hole 57 comprises a contact holding section 57*a* formed at its lower portion and an upper hole 57*b* formed above the contact holding section 57*a*. The upper hole 57*b* communicates with an insertion hole 57*c* bored in the upper end face of the guide protrusion 56.

A power receptacle contact 70 is inserted into and held by thus formed power-contact holding hole 57. The power receptacle contact 70, which is made of a sheet-like conductive material, comprises contact sections 71, 71 opposing each other in the front-to-back direction; a connection section 72 connecting the contact sections 71, 71 together at their lower portions; and lead sections 73, 73 respectively extending forward and backward below the connecting section 72, each being bent like a crank. The contact sections 71, 71 are formed so as to be slightly inclined to each other such that their upper portions come closer to each other, while the upper end portions are curved so as to project inward and open upward, thereby facilitating the insertion of the power plug contact 30.

In the power-contact holding hole 57, the size of the contact holding section 57*a* in the right-to-left direction is made larger than that of the upper hole 57*b*. On the other hand, the width of the contact sections 71, 71 in the right-to-left direction in the power receptacle contact 70 is made slightly smaller than that of the upper hole 57*b*, while the width of the connecting section 72 is such that it can be pressed into and held by the contact holding section 57*a*. The receptacle contact 70 is inserted (pressed) into the power-contact holding hole 57 from below the receptacle housing 50 till the upper end face 72*a* of the connecting section 72 abuts to the upper face of the contact holding section 57*a*, and held thereby.

Further, attached to the right and left end portions of the receptacle housing 50 so as to extend it outward are receptacle-connector securing metal parts 80, 80 which also serve as metal parts for grounding a printed circuit board K5. Each receptacle-connector securing metal part 80 comprises a planar section 81, an ascending section 82 extending vertically upward from the planar section 81, and a holding section 83 extending from the upper end portion of the ascending section 82 in the right-to-left direction into a U-shaped form. Thus configured plug-connector securing metal parts 80, 80 are held by the receptacle 50 such that the right and left end portions of the receptacle housing 50 are held by the holding sections 83.

The outer peripheral face 52*b* of the side wall section 52 and the outer face 83*a* of the holding section 83 are positioned on the same plane while being held by the receptacle housing 50. Here, as with the planar section 41, the planar section 81 is burring-processed and is provided with a tap.

Thus configured plug connector 5 is adapted to be attached to the printed circuit board K5 by means of the tap formed in the planar section 81 with the securing thread N in the state where the planar section 81 abuts to the power wiring pattern formed in the printed circuit board K5 or the case, while the upper end faces of the lead sections 63, 63' of the receptacle contacts 60, 60' and the lower end face of the lead section 73 of the power receptacle contact 70 are mounted and soldered on the wiring pattern formed in the printed circuit board K1 and the power wiring pattern formed in the printed circuit board K5, respectively.

In the following, explained is the case where the thus configured plug connector 1 is attached to the main body of a personal computer which is not depicted, whereas the receptacle connector 5 is used for a battery pack and a CD-ROM drive which are selectively connected to this personal computer.

In the plug connector 1, while the individual contacts 20 and 30 are soldered onto the printed circuit board implemented in the main body of the personal computer as mentioned above, the plug-connector securing metal parts 40 are attached to the case of the computer.

When the receptacle connector 5 is used as a connector for a battery pack, the power receptacle contacts 70, 70 at both ends and several pieces of the receptacle contacts 60 and 60' are soldered onto a printed circuit board implemented in the battery pack. With thus configured battery pack, when the receptacle connector 5 is connected to the plug connector 1 attached to the main body of the computer, electric power can be supplied to the computer, while the computer can display the remaining power of the battery pack or the like.

Since the positioning protrusions 18, 18 are formed in the plug housing 1 only on the rear side, while the positioning grooves 58, 58 are formed in the receptacle housing 5 only on the rear side, the connectors 1 and 5 cannot be connected together in the state where the front and rear (right and left) sides of the connectors are reversed. Also, since the guide protrusions 56, 56 are formed at the right and left end portions of the receptacle connector 5, even in the state where the positions of the plug-contact holding section 14 and the receptacle-side space 53 do not coincide with each other, as both connectors 1 and 5 are brought closer to each other so as to mate with each other, the end faces of the right and left end portions of the outer side wall section 12 abut to the slopes of the guide protrusions 56, 56, allowing the plug-contact holding section 14 to move to the position (where the positioning protrusions 18, 18 align with the positioning grooves 58, 58) at which the plug-contact holding section 14 can be inserted into the receptacle-side space 53.

With thus configured plug connector 1 and receptacle connector 5, when both connectors 1 and 5 mate together, the positioning protrusion 18 and positioning groove 58 function to prevent the power contacts 30 and 70 disposed at the right and left ends of the connectors 1 and 5 from connecting with each other with their polarities (+, −) reversed and keep the receptacle connector 5 from being obliquely inserted into the plug connector 1.

When both connectors 1 and 5 mate together, the contact 43*a* of the plug-connector securing metal part 40 and the outer face 83*a* of the holding section 83 in the receptacle-connector securing metal part 80 come into contact with each other, so that the plug-connector securing metal part 40 and the receptacle-connector securing metal part 80 are electrically connected to each other. Accordingly, the battery pack can attain an enhanced state of grounding. Further, since both grounding metal parts 40 and 80 are respectively disposed so as to surround parts of the outer peripheries of the power contacts 30 and 70 by the holding sections 43 and 83, they can partially block (by shielding) the noise generated at the power contacts 30 and 70 when electric power is supplied thereto, allowing the noise generated from the connector to decrease.

In the above-mentioned plug connector 1 and receptacle connector 5, there are cases where they are mated together or removed from each other in the state where electric power is supplied to the power contacts 30 and 70, i.e., so-called hot-plugging results. Accordingly, at the time when both connectors 1 and 5 mate together, the grounding metal parts 40 and 80, the power contacts 30 and 70, and the signal contacts 30, 60, and 60' are successively connected to each other sequentially, thereby preventing the power contacts from generating noises which may be mistaken as a signal.

Namely, the grounding metal parts 40 and 80, individual contacts 30 and 60, and the like are formed and disposed in their corresponding housings 10 and 50 such that, at the time when both connectors 1 and 5 mate together, the grounding metal parts 40 and 80 are initially connected together, then the power contacts 30 and 70 are connected together, thereafter the receptacle contacts 60 with the longer contact section 61 and the plug contacts 30 are connected together, and finally the receptacle contacts 60' with the shorter contact section 61' and the plug contacts 30 are connected together.

Here, in the connector in accordance with the present invention, it is not always necessary for the grounding metal parts 40 and 80, the power contacts 30 and 70, and the signal contacts 30, 60, and 60' to be connected to each other in this order. The order of their connection may appropriately be changed according to the instruments used, for example, such that the receptacle contacts 60 and the plug contacts 30 are connected together substantially at the same time when both power contacts 30 and 70 are connected together, and then the receptacle contacts 60' and the plug contacts 30 are connected together substantially at the same time when the grounding metal parts 40 and 80 are connected together.

When the receptacle connector 5 is used as a connector for a CD-ROM drive, on the other hand, the receptacle contacts 60 and 60' are soldered onto a printed circuit board implemented in the CD-ROM drive while leaving the power receptacle contacts 70, 70 at both ends unconnected. With thus configured CD-ROM drive, as the receptacle connector 5 is connected to the plug connector 1 attached to the main body of the computer, the CD-ROM can be used as an external storage device for the computer.

There are cases where the CD-ROM drive and the computer are connected together or disconnected from each other while electric power is supplied to either the main body of the computer or the CD-ROM drive or both. In such cases, when the connectors are mated together or detached from each other, it may become necessary for the signal contacts to be sequentially connected such that, of various signals transmitted through the individual contacts, some signals are transmitted earlier and later than the other signals (some contacts are connected earlier and later than the others) with respect to time of connection and disconnection.

When both connectors 1 and 5 mate together, the plug contacts 20 come into contact with the receptacle contacts 60 and 60'. Here, as mentioned above, the plug housing 10 is inserted in straight fashion into the receptacle housing 50 due to the positioning protrusions 18, 18 and the positioning grooves 58, 58. Consequently, the receptacle contacts 60 with the long contact section 61 come into contact with the plug contacts 20 earlier than the receptacle contacts 60' with the short contact section 61' do.

Accordingly, when the receptacle contacts 60 with the long contact section 61 are used for signals to be transmitted earlier and cut off later, while the receptacle contacts 60' with the shorter contact section 61' are used for the other signals, sequential connection can result securely.

Though the foregoing explanation is directed to the case where the plug contacts 20 and receptacle contacts 60 and 60' are used for transmitting signals alone, the present invention should not be restricted thereto. For example, a part of the plug contacts 20 and receptacle contacts 60 and 60' may be used as contacts for connecting with electric power separately from or in cooperation with the power contacts 30 and 70.

Namely, when there is a signal to be connected after the power is supplied or to be disconnected before the power is cut off upon mating/detaching of the connectors, the receptacle contacts 60 with the long contact section 61 are used for the power. In contrast, when there is a signal to be connected before the power is supplied or to be disconnected after the power is cut off upon mating/detaching of the connectors, the receptacle contacts 60' with the short contact section 61' are used for the power.

Though the receptacle contacts 60 and 60' are made with different lengths so as to effect the sequential connection among the signal contacts 20, 60, and 60' in the connector mentioned above, the present invention should not be restricted thereto. For example, the length of the plug contacts 20 may be varied in order to effect the sequential connection.

In the above-mentioned connector, in the personal computer and CD-ROM drive cases the devices can be electrically connected to each other by means of the plug-connector securing metal parts 40 and the receptacle-connector securing metal parts 80, the potential difference between the personal computer case and the CD-ROM drive case can be nullified (both cases can attain the same potential), whereby the generation of noise can be reduced as well.

Though both grounding metal parts 40 and 80 are used for the enhancement of grounding and the shielding of the noise from the power contacts in the above-mentioned connector, they may also be used as power contacts for supplying electric power in addition to the power contacts 30 and 70. Accordingly, even when a sufficient power cannot be supplied through the power contacts 30 and 70 alone, the grounding metal parts 40 and 80 can supplement the power.

Though the contacts 30 and 70 for supplying the power from the battery pack are disposed at the right and left end portions of the connectors 1 and 5 outside of the contacts 20, 60, and the like in the right-to-left direction, the present invention should not be restricted thereto. For example, the power contacts 30 and 70 may be disposed at positions asymmetrical to each other in the right-to-left direction with respect to the signal contacts 20, 60, and the like such that the signal contacts 20, 60, and the like do not accidentally come into contact with the power contacts 30 and 70.

Figure 11:
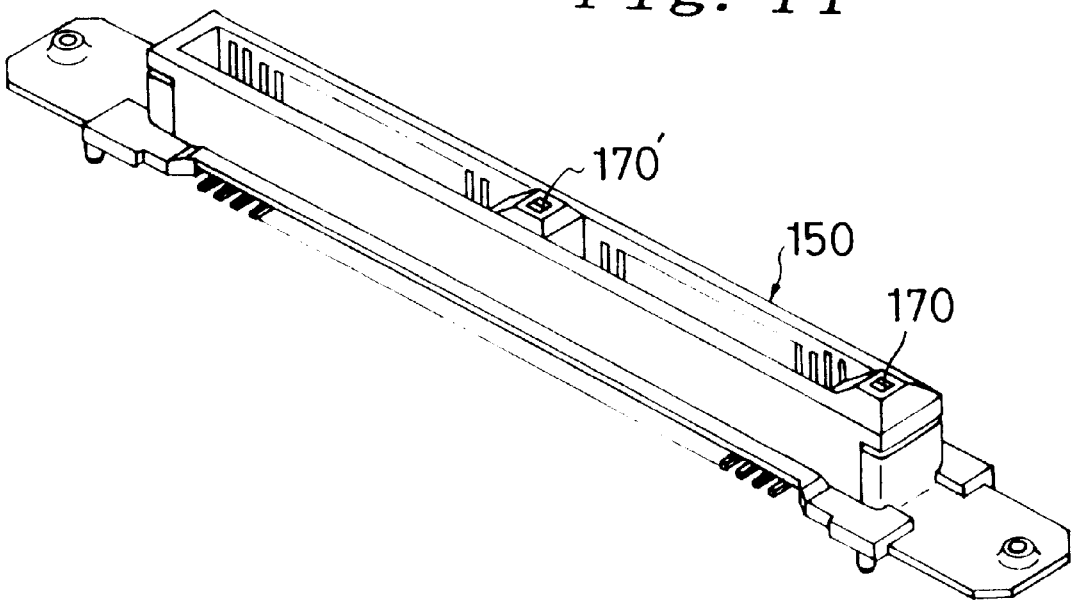
FIG. 11 is a perspective view showing another configuration of the receptacle connector in accordance with the present invention.
Figure 12:
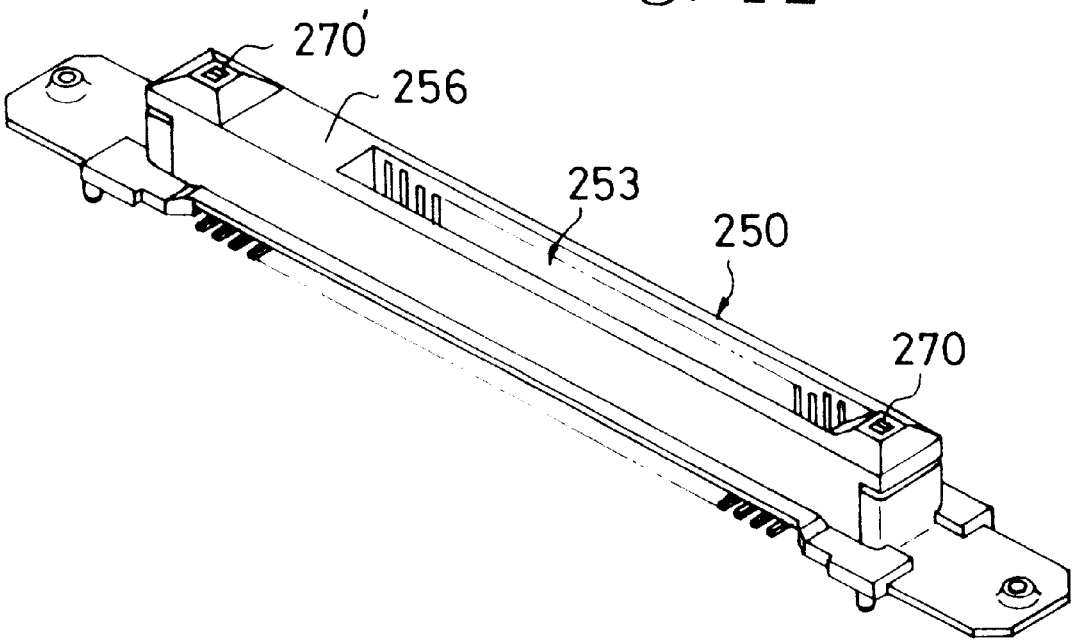
FIG. 12 is a perspective view showing still another configuration of the receptacle connector in accordance with the present invention.

For example, in terms of receptacle contacts, as shown in FIG. 11, one power receptacle contact 170 may be disposed at an end portion of a receptacle housing 150, whereas the other receptacle contact 170' may be disposed at the center portion of the receptacle housing 150. Alternatively, as shown in FIG. 12, power receptacle contacts 270 and 270' may respectively be disposed at both end portions of a receptacle housing 250, while only one power receptacle contact 270' is provided with a blocking section 256 for blocking a receptacle-side space 253, thereby preventing the non-depicted plug connector from mating with the receptacle connector with the right and left sides reversed.

Though the holding sections 43 and 83 have U-shaped forms so as to surround the outer peripheries of the power contacts 30 and 70 at the right and left end portions in the respective housings 10 and 50 in the above-mentioned connector, thereby blocking the noise generated from the power contacts, they may be extended so as to cover all the peripheries of the housings 10 and 50 in order to enhance the shielding effects. This configuration can block the noises generated not only from the power contacts 70 and the like but also from the signal contacts 60 and the like.

Since both connectors 1 and 5 are to be attached onto the circuit boards in the above-mentioned connector, each of the grounding metal parts 40 and 80 substantially has an L-shaped form such that the bottom surfaces of the flat sections 41 and 81 of the grounding metal parts 40 and 80 are positioned on substantially the same plane with the bottom surfaces of the housings 10 and 50. It is not always necessary for the grounding parts to be formed into a substantially L-shaped form, however. For example, it may have a U-shaped form so as to be secured to the case or the like in the directions of the right and left side faces of the connector. Alternatively, the grounding metal parts may have a substantially L-shaped form such that their planar sections are positioned in parallel with the front face or rear face of the connector, so as to be secured to the case on the front face or rear face side of the connector.

Though the above-mentioned connectors 1 and 5 are attached to their respective circuit boards K1 and K5 by means of taps formed on the flat sections 41 and 81 of the grounding metal parts 40 and 80 after the burring processing, it is not always necessary for the flat sections 41 and 81 to be provided with the taps, and they may simply be bored with through-holes for attachment. Further, when the connectors are to be attached to the circuit boards by soldering, the taps and through-holes may not be formed.

The invention being thus described, it will be obvious that the same may be varied in many ways. Such variations are not to be regarded as a departure from the spirit and scope of the invention. All such modifications would be obvious to one skilled in the art, and are intended to be included within the scope of the following claims.

RELATED APPLICATIONS

This application claims the priority of Japanese Patent Application No. 8-134578 filed on May 29, 1996, and No. 9-23428 filed on Feb. 6, 1997 which is incorporated herein by reference.

What is claimed is:

1. A connector assembly comprising a plug connector holding a plurality of signal contacts, each extending in a mating direction, and aligned in a row extending transversely of the mating direction and longitudinally between opposite ends of a plug housing; and a receptacle connector holding a plurality of signal contacts, each extending in a mating direction, and aligned in a row extending transversely of the mating direction and longitudinally between opposite ends of a receptacle housing; said signal plug contacts connecting with respective, corresponding signal receptacle contacts as said plug connector is received in and mated with said receptacle connector; said connector assembly further comprising:

two poles of power plug contacts disposed within said plug housing at respective opposite ends of said row of signal plug contacts in alignment therewith and extending in the mating direction;

two poles of power receptacle contacts disposed within said receptacle housing at respective opposite ends of with said row of signal receptacle contacts in alignment therewith and extending in the mating direction, said power receptacle contacts being connected to said power plug contacts when said plug connector is received in and mated with said receptacle connector;

a conductive plug-connector securing metal part disposed at each of said opposite ends of said plug housing; and a conductive receptacle-connector securing metal part disposed at each of said opposite ends of said receptacle housing, said receptacle-connector securing metal part being adapted to connect with said plug-connector securing, metal part when said plug connector and said receptacle connector mate together, said plug-connector securing metal part and said receptacle-connector securing metal part being electrically insulated from said power plug contacts and said power receptacle contacts and disposed so as to respectively cover at least parts of outer peripheries of said power plug contacts and power receptacle contacts.

2. A connector assembly according to claim 1, wherein said power plug contacts and power receptacle contacts are disposed at positions asymmetrical to each other direction of a respective row with respect to said signal plug contacts and signal receptacle contacts, respectively.

3. A connector assembly according to claim 1, wherein heights of said securing parts, power contacts, and signal contacts in the mating direction thereof are set such that, when said plug connector is received in and mated with said receptacle connector, said plug-connector securing metal part and receptacle-connector securing metal part are initially connected together, then said power plug contacts and power receptacle contacts are connected together, and thereafter said signal plug contacts and signal receptacle contacts are connected together.

4. A connector assembly comprising a plug connector holding a plurality of signal contacts, each extending in a mating direction, and aligned in a row extending transversely of the mating direction and longitudinally between opposite ends of a plug housing; and a receptacle connector holding a plurality of signal contacts, each extending in a mating direction, and aligned in a row extending transversely of the mating direction and longitudinally between opposite ends of a receptacle housing; said signal plug contacts connecting with respective, corresponding signal receptacle contacts as said plug connector is received in and mated with said receptacle connector; said connector assembly further comprising:

two poles of power plug contacts disposed within said plug housing at respective opposite ends of said row of signal plug contacts in alignment therewith and extending in the mating direction;

two poles of power receptacle contacts disposed within said receptacle housing at respective opposite ends of with said row of signal receptacle contacts in alignment therewith and extending in the mating direction, said power receptacle contacts being connected to said power plug contacts when said plug connector is received in and mated with said receptacle connector;

a conductive plug-connector securing metal part disposed at each of said opposite ends of said plug housing; and a conductive receptacle-connector securing metal part disposed at each of said opposite ends of said receptacle housing, said receptacle-connector securing metal part being adapted to connect with said plug-connector securing, metal part when said plug connector and said receptacle connector mate together, wherein said receptacle-connector securing metal parts and said plug-connector securing metal parts include respective shielding portions each having a pair of arms extending in spaced apart relation from a bight to form a U-shape with an axis extending in the mating direction and a mouth opening toward the row so as to at least partly surround respective power plug contacts and power receptacle contacts, said receptacle-connector securing metal parts being adapted to connect with said plug-connector securing metal parts by mating of respective said shielding portions.

* * * * *

UNITED STATES PATENT AND TRADEMARK OFFICE

CERTIFICATE OF CORRECTION

PATENT NO. : 6,007,352
DATED : December 28, 1999
INVENTOR(S) : Yoichiro Azuma et al.

It is certified that error appears in the above-identified patent and that said Letters Patent is hereby corrected as shown below:

Title page,
Item [73] Assignee should read -- Kel Corporation --.

Signed and Sealed this

Fourteenth Day of May, 2002

*Attest:*

*Attesting Officer*

JAMES E. ROGAN
*Director of the United States Patent and Trademark Office*